US006941705B2

(12) United States Patent
Pontarolo

(10) Patent No.: US 6,941,705 B2
(45) Date of Patent: Sep. 13, 2005

(54) ACCESSORY FOR MODULAR ELEMENTS FOR THE SUPPORT AND VENTILATION OF CRAWL SPACES, FLOOR STRUCTURES, FLOORS OR SIMILAR ARTICLES IN THE BUILDING FIELD

(76) Inventor: Valerio Pontarolo, Via Santa Caterina, Cordovado (PN) (IT), 4/A-33073

( * ) Notice: Subject to any disclaimer, the term of this patent is extended or adjusted under 35 U.S.C. 154(b) by 18 days.

(21) Appl. No.: 10/276,378

(22) PCT Filed: May 9, 2001

(86) PCT No.: PCT/IB01/00801

§ 371 (c)(1),
(2), (4) Date: Nov. 15, 2002

(87) PCT Pub. No.: WO01/88298

PCT Pub. Date: Nov. 22, 2001

(65) Prior Publication Data

US 2003/0115809 A1 Jun. 26, 2003

(30) Foreign Application Priority Data

May 16, 2000 (IT) ..... UD2000A0097

(51) Int. Cl.[7] ..... E04B 1/32
(52) U.S. Cl. ..... 52/80.1; 52/577
(58) Field of Search ..... 52/80.1, 80.2, 52/81.3, 82, 83, 67, 2.12, 577, 437, 438, 505, 220.2; 135/121, 95

(56) References Cited

U.S. PATENT DOCUMENTS 795,984 A * 8/1905 Julian ..... 454/183
1,275,668 A * 8/1918 Filippone ..... 52/329
1,591,711 A * 7/1926 Kane ..... 52/577
1,608,491 A * 11/1926 Conway ..... 52/577
2,792,164 A * 5/1957 Cauffiel ..... 182/194
3,178,856 A * 4/1965 Fritz ..... 52/337
3,543,458 A 12/1970 Guritz
3,555,748 A * 1/1971 Herman ..... 52/67
4,655,013 A * 4/1987 Ritland ..... 52/81.4
5,634,311 A * 6/1997 Carlton ..... 52/577
6,327,822 B1 * 12/2001 Grande II ..... 52/80.1

FOREIGN PATENT DOCUMENTS

| | | |
|---|---|---|
| DE | 2437400 | 2/1976 |
| EP | 0385876 | 9/1990 |
| EP | 0803618 | 10/1997 |
| GB | 2296086 | 6/1996 |
| WO | 0052279 | 9/2000 |

* cited by examiner

*Primary Examiner*—Korie Chan
(74) *Attorney, Agent, or Firm*—Stevens, Davis, Miller & Mosher, LLP

(57) ABSTRACT

Accessory (20) for modular elements (10) for the support and ventilation of crawl spaces, floor structures, floors or similar articles in the building field, each comprising an upper horizontal wall (11) and a plurality of vertical supporting legs (13) defining a continuous passage below said upper wall (11), said accessory (20) comprising a front wall (21) and a lateral wall (22) having a profile mating with that of the aperture defined by each pair of vertical legs (13) of a modular element (10).

20 Claims, 3 Drawing Sheets

ACCESSORY FOR MODULAR ELEMENTS FOR THE SUPPORT AND VENTILATION OF CRAWL SPACES, FLOOR STRUCTURES, FLOORS OR SIMILAR ARTICLES IN THE BUILDING FIELD

FIELD OF THE INVENTION

The invention concerns an accessory for modular elements, used for support and ventilation, able to achieve crawl spaces, floor structures, floors or similar articles in the building field, which is able to cooperate with said modular elements to perform the function of closing them and possibly also of laterally extending them. The accessory according to the invention comprises a plane lateral wall and a curved wall, which can be smooth or undulating to form a plurality of coupling elements able to cooperate with a mating coupling element in the modular element. The type of coupling ensures also stability between modular element and accessory.

BACKGROUND OF THE INVENTION

The EP-B-0 803 618, by the same inventor as this invention, describe modular elements to achieve crawl spaces or floor structures, wherein every element has a horizontal upper wall, slightly curved and substantially square, and four vertical supporting legs arranged at the corners of the upper wall.

The four vertical legs are connected to each other by curved elements which define a continuous passage between the various modular elements, below the upper wall, and are provided with appropriate curved grooves, each of which is able to couple with a mating groove of another modular element. In this way, the modular elements are able to couple with each other laterally to form a ventilated crawl space, floor structure or floor of a size which is a multiple of a modular element.

The lateral size of each modular element, which is standardized at a value of around half a meter, may therefore represent a limitation to the use of such modular elements, when the floors or surfaces to be covered are not exactly a whole multiple of said lateral size. In such circumstances, in fact, it is necessary to cut the modular elements in width, in order to put portions thereof adjacent to the whole elements already positioned, with a consequent waste of time and material.

The GB-A-2 296 086 discloses a climate control system which comprises a heat retentive floor slab, a heat retentive screed over the floor slab, a pattern of conduits disposed according to a matrix of rows perpendicular therebetween and extending within the screed, means to connect the conduits to a source of heated or cooled air to heat or cool the floor slab and screed, and means to vent air from the conduits. This system does not permit to easily adapt the dimensions of the elements, used to form the pattern of conduits, to the dimensions of the floor to realize. In fact the sole manner to vary the dimensions of the conduits is to cut them at the desired lengths.

SUMMARY OF THE INVENTION

The invention is set forth and characterized in the main claim, while the dependent claims describe other innovative characteristics of the invention.

A first purpose of the invention is to achieve an accessory for supporting and ventilation modular elements which can easily couple with said modular elements in order to laterally close the lateral apertures of the modular elements located at the ends of the set, in such a manner that the concrete which is cast to cover them does not occupy the part below the horizontal wall of the modular elements.

A second purpose of the invention is to act as a lateral extension or spacer element for said modular elements, so that with the latter, and at least one accessory according to the invention, it is possible to completely cover any surface or floor having a lateral size which is not exactly that of a whole multiple of the unitary width of one modular element, but which also comprises a fraction of said unitary width.

In accordance with these purposes, the accessory according to the invention comprises a substantially vertical front wall, or inclined with respect to a vertical plane, and a lateral wall with a profile matching that of the apertures, for example curved, defined by each pair of vertical legs of the modular element. The lateral wall can be both smooth and it can have an undulating development so as to form a plurality of curved peaks and valleys, lying on substantially vertical planes and having substantially the same profile as the curved groove of the modular element, so that the latter can couple selectively with each of said curved peaks.

The height of the curved wall is such that it can easily be inserted into each of the four apertures defined by the four legs of the modular element, even when the apertures are of different heights among themselves.

When it is able to be associated with modular elements provided with a vertical column arranged centrally below the upper wall, the accessory according to the invention is provided with a central hollow made on the curved wall, in an inner position, opposite said front wall. In this way the central hollow prevents any interference between the vertical column and the accessory when the latter is completely inserted below the upper wall.

The accessory according to the invention can also be used as an intermediate spacer element, as a tunnel, between two modular elements. In this case the front wall is able to be removed, at least partly, or provided with through holes, to achieve a continuous passage between the two modular elements connected by the accessory.

Moreover, the accessory according to the invention is also provided with attachment means made in correspondence with the front edge of the curved wall opposite that where there is the front wall. In this way two accessories can couple together so that one can be an extension of the other, and can be attached to each other head to head, with the front walls arranged at the ends, so as thus to constitute an extension element which is double the length of a single accessory. In this case too the front walls of the two accessories will be at least partly removed, or holed, to achieve the tunnel between the modular elements connected by the two coupled accessories.

BRIEF DESCRIPTION OF THE DRAWINGS

These and other characteristics of the invention will be clear from the following description of a preferred form of embodiment, given as a non-restrictive example, with reference to the attached drawings wherein.

DETAILED DESCRIPTION OF PREFERRED EMBODIMENT

Figure 2:
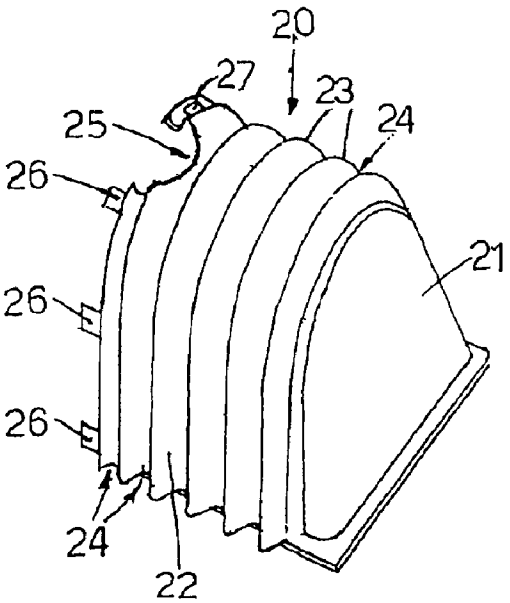
FIG. 2 is a prospective view of an accessory according to the invention.
Figure 1:
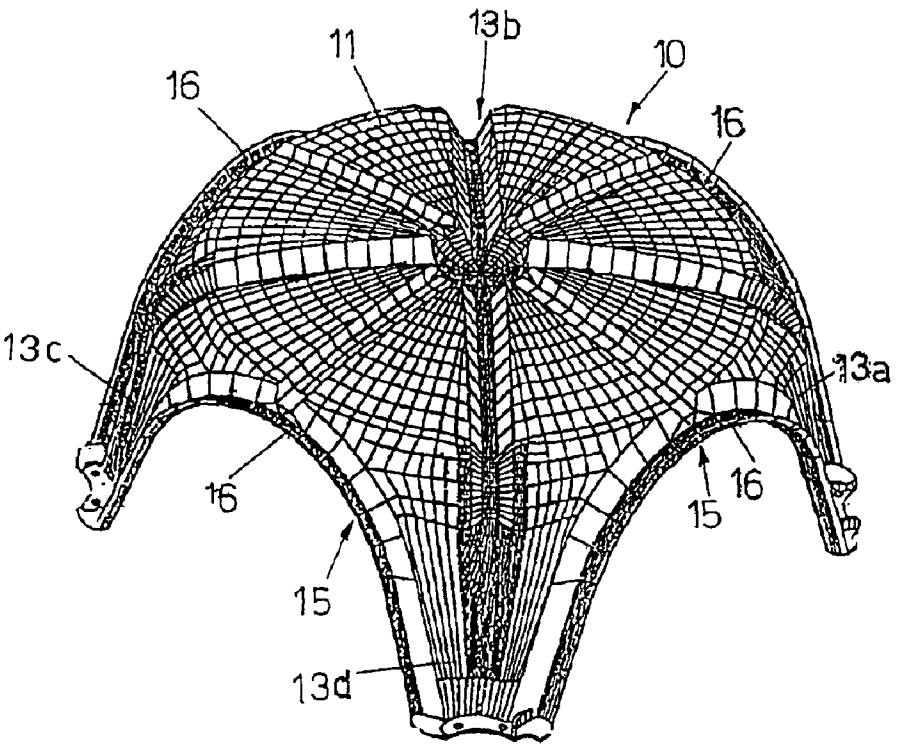
FIG. 1 is a three-dimensional view of a conventional modular element, with which the accessory according to the invention can be coupled.

With reference to FIG. 1, a conventional modular element 10 comprises for example a monoblock structure, made of plastic material, which has an upper horizontal wall 11, slightly convex, substantially square, at the corners of which there are four vertical supporting legs 13 (13*a*, 13*b*, 13*c* and 13*d*).

The legs 13 are connected by arches 15 which define a continuous passage below the upper wall 11. The arches 15 are each provided with a groove 16 by means of which each modular element 10 can be coupled with a corresponding groove 16 of another modular element 10. The width of the modular element 10 is standardized at a value of about half a meter. For example, modular elements with a width "1" of 560 mm are readily available on the market.

For a more detailed description of the modular element 10, please refer to the afore-mentioned Italian patents IT-B-1.288.881 and IT-B-1.292.348.

An accessory 20 (FIGS. 2–6) according to the invention, also made of plastic material or similar, advantageously of an ecological and/or recyclable type, for example made by means of molding, comprises a front wall 21 and a curved lateral wall 22 which is able to couple with each of the arches 15 defined by each pair of vertical legs 13 of the modular element 10.

The height of the curved wall 22 is such that it can be easily inserted into each of the four arches 15 defined by the four vertical legs 13 of the modular element 10, even if the arches 15 are of different heights from each other.

The front wall 21 is substantially vertical, or inclined by some degrees, advantageously from 5° to 15°, to allow several accessories 20 to be easily stacked one on top of the other, for example for storage and transport.

The curved wall 22 can be smooth, or advantageously have an undulating development so as to form a plurality of peaks 23 and curved valleys 24, lying on substantially vertical planes and having substantially the same profile as the curved groove 16 of the modular element 10, so that such curved groove 16 can selectively couple with each of the curved valleys 24.

According to the form of embodiment described here, the pitch "p" between the curved valleys 24 is substantially constant and is a fraction of the unitary width of the modular element 10, even if this is not an essential characteristic of the invention. In the form of embodiment shown here the pitch "p" is 65 mm.

The length of the accessory 20 is substantially equal to about half the length "1" of the modular element 10.

The curved wall 22, in an inner position, opposite the front wall 21, is provided with a central hollow 25 able to house a part of a corresponding vertical column 18 of the modular element 10, arranged in a central position below the upper wall 11.

Figure 6:
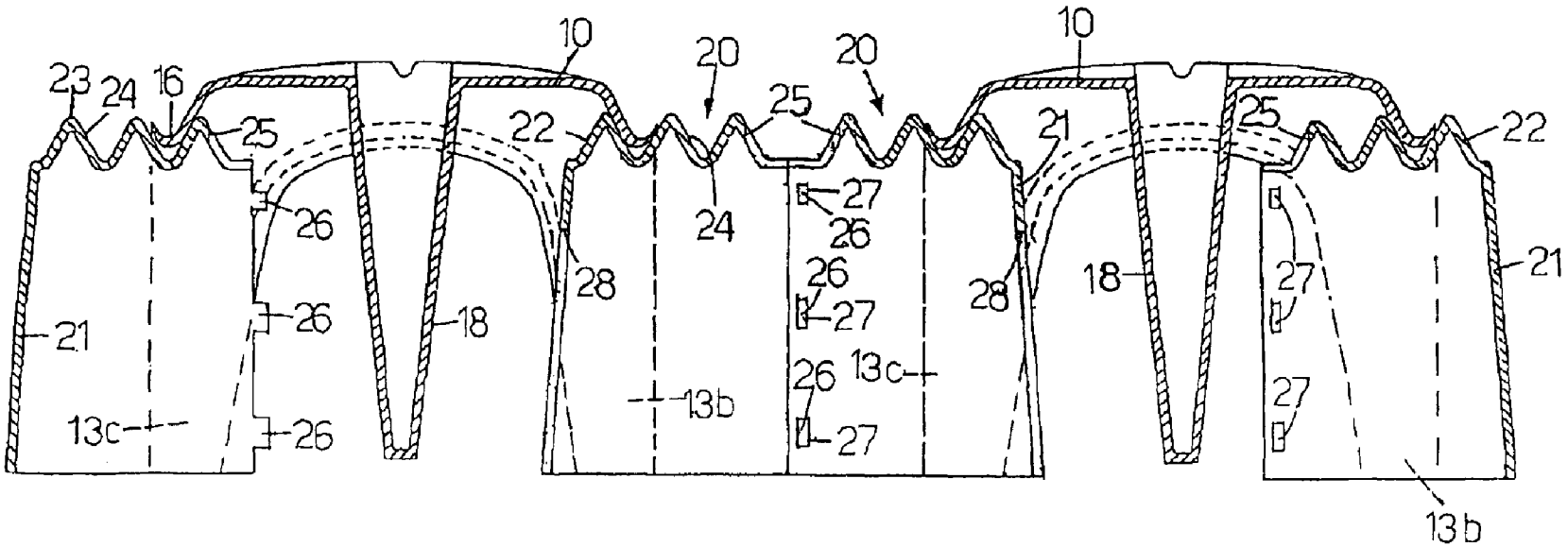
FIG. 6 is a transverse section showing two modular elements with which four accessories according to the invention cooperate, two of which are attached to each other.

On the inner edge of the curved wall 22, below the central hollow 25, each accessory 20 is also provided on one side with attachment elements 26, and on the other side with corresponding apertures 27. The attachment elements 26 of one accessory 20 are able to attach themselves to the corresponding apertures 27 of another accessory 20 (FIG. 6). In this way two accessories 20 (the central ones in FIG. 6) can couple together so that one is an extension of the other and can be attached to each other head to head, with the front walls 21 arranged inside the corresponding modular element 10, so as thus to constitute an extension element which is double the length of a single accessory 20.

In this case, that is, when the accessory 20 does not function as a closing element, but as an extension element between two modular elements 10, the front wall 21 is able to be at least partly removed, or holed to define a corresponding front aperture 28 and thus achieve a tunnel between the modular elements 10 connected by a single accessory 20 (this condition is not shown in the drawings) or by two accessories 20 coupled together.

Figure 3:
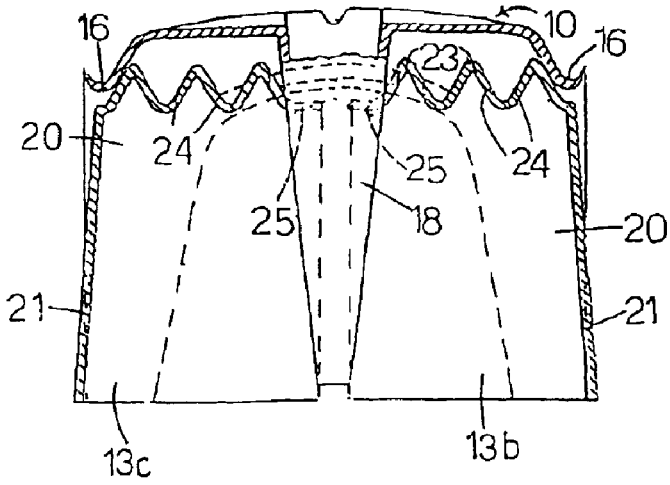
FIG. 3 is a transverse section showing two accessories according to the invention coupled with a modular element, in a first operating position.

FIG. 3 shows two accessories 20 inserted into the arches 15 below the wall 11 of a modular element 10. In this position the column 18 is inserted in the hollows 25. In this position the accessories 20 practically do not perform any function as a lateral extension of the modular element 10, since the two accessories 20 are completely housed below the upper wall 11.

Figure 4:
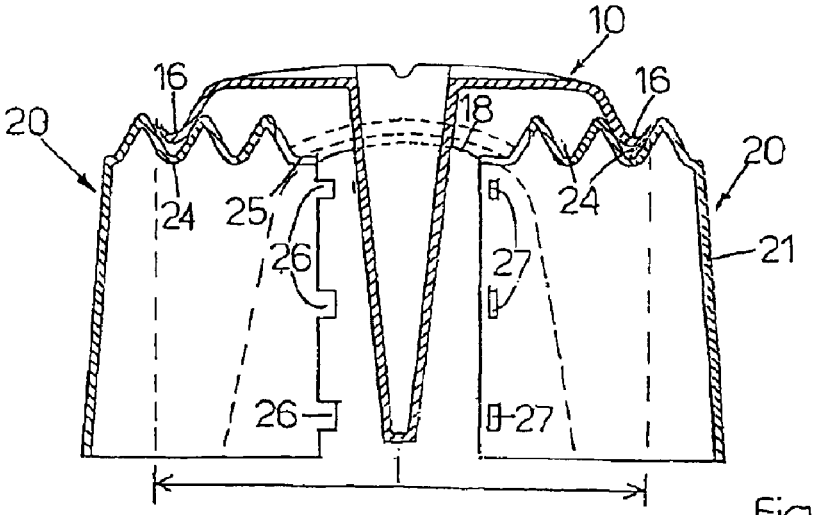
FIG. 4 is a transverse section showing two accessories according to the invention coupled with a modular element, in a second operating position.
Figure 5:
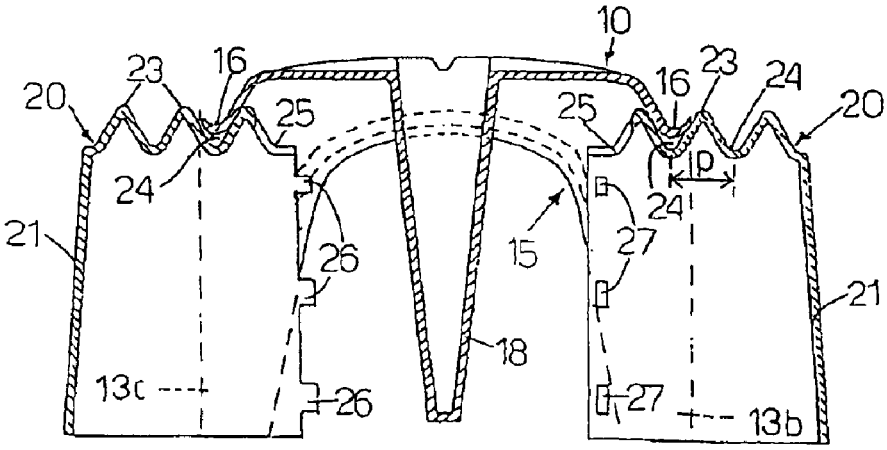
FIG. 5 is a transverse section showing two accessories according to the invention coupled with a modular element, in a third operating position.

FIGS. 4 and 5 show other positions which each of the accessories 20, autonomously and independently, can assume with respect to the modular element 10. It can be seen how, in this case, the distance of the lateral extension of each accessory 20 is equal to a whole multiple of the pitch "p", since the grooves 16 of the modular element 10 are always coupled with a corresponding curved valley 24.

It is clear that modifications and additions may be made to the accessory 20 as described heretofore, but these shall remain within the field and scope of the invention.

It is also clear that, although the invention has been described with reference to a specific example, a person of skill shall certainly be able to achieve many other equivalent forms, all of which shall come within the field and scope of the invention.

What is claimed is:

1. Accessory in combination with modular elements for the support and ventilation of crawl spaces, floor structures, or floors, wherein each one of said modular elements comprises an upper horizontal wall and a plurality of vertical supporting legs, and wherein the lateral profiles of each pair of said vertical supporting legs define a corresponding lateral aperture for obtaining a continuous passage below said upper wall, said accessory comprising a front wall and at least a lateral wall connected to said front wall and having-substantially the same shape of said lateral profiles of each pair of said vertical supporting legs of the respective modular element, whereby said front wall and said lateral wall are able to selectively close said lateral aperture of the modular element, the position of said lateral wall with respect to the lateral profiles of each pair of said vertical supporting legs of the modular element being selectively variable for consequently varying the distance between said front wall and said modular element, whereby said accessory is able both to close said lateral aperture of the modular element and to act as an extension element for said modular element, wherein said front wall is inclined by about 5°–15° with respect to a vertical plane.

2. Accessory as in claim 1, wherein said lateral wall is smooth.

3. Accessory as in claim 1, wherein said lateral wall has an undulating development so as to form a plurality of peaks and valleys lying on substantially vertical planes.

4. Accessory as in claim 3, wherein each one of said lateral profiles comprises an arch between each pair of said legs, wherein said lateral wall is curved to follow the profile of said arch, wherein each arch is provided with a groove, and wherein each of said valleys has a profile mating with that of said groove to accommodate it inside.

5. Accessory as in claim 3, wherein said valleys are curved and the pitch between said curved valleys is substantially constant and is a fraction of the unitary width of said modular element.

6. Accessory as in claim 1, wherein each one of said lateral profiles comprises an arch between each pair of said legs, wherein said lateral wall is curved to follow the profile of said arch.

7. Accessory as in claim 1, wherein the height of said lateral wall is such that said lateral wall can be selectively inserted easily into every one of the apertures defined by said vertical legs of the modular element, even if said apertures are of different heights from each other.

8. Accessory as in claim 1, wherein a length of the accessory substantially equal to about half the length of said modular element.

9. Accessory as in claim 1, wherein on the inner edge of said lateral wall, opposite said front wall, there are on one side first attachment elements and on the other side corresponding second attachment elements, said first attachment elements of one accessory being able to attach themselves with the corresponding second attachment elements of another accessory to define a single extension element for said modular elements.

10. Accessory in combination with modular elements for the support and ventilation of crawl spaces, floor structures, or floors, wherein each one of said modular elements comprises an upper horizontal wall and a plurality of vertical supporting legs, and wherein the lateral profiles of each pair of said vertical supporting legs define a corresponding lateral aperture for obtaining a continuous passage below said upper wall, said accessory comprising a front wall and at least a lateral wall connected to said front wall and having-substantially the same shape of said lateral profiles of each pair of said vertical supporting legs of the respective modular element, whereby said front wall and said lateral wall are able to selectively close said lateral aperture of the modular element, the position of said lateral wall with respect to the lateral profiles of each pair of said vertical supporting legs of the modular element being selectively variable for consequently varying the distance between said front wall and said modular element, whereby said accessory is able both to close said lateral aperture of the modular element and to act as an extension element for said modular element, wherein said modular element comprises a vertical column arranged in a central position below said upper wall, wherein said lateral wall, in an inner position, opposite said front wall, is provided with a central hollow able to house a part of said column.

11. Accessory as in claim 10, wherein said front wall is substantially vertical.

12. Accessory as in claim 10, wherein said lateral wall is smooth.

13. Accessory as in claim 10, wherein said lateral wall has an undulating development so as to form a plurality of peaks and valleys lying on substantially vertical planes.

14. Accessory as in claim 13, wherein each one of said lateral profiles comprises an arch between each pair of said legs, wherein said lateral wall is curved to follow the profile of said arch, wherein each arch is provided with a groove, and wherein each of said valleys has a profile mating with that of said groove to accommodate it inside.

15. Accessory as in claim 14, wherein said valleys are curved and the pitch between said curved valleys is substantially constant and is a fraction of the unitary width of said modular element.

16. Accessory as in claim 13, wherein said valleys are curved and the pitch between said curved valleys is substantially constant and is a fraction of the unitary width of said modular element.

17. Accessory as in claim 10, wherein each one of said lateral profiles comprises an arch between each pair of said legs, wherein said lateral wall is curved to follow the profile of said arch.

18. Accessory as in claim 10, wherein the height of said lateral wall is such that said lateral wall can be selectively inserted easily into every one of said four apertures defined by said vertical legs of the modular element.

19. Accessory as in claim 10, wherein a length of the accessory is substantially equal to about half the length of said modular element.

20. Accessory as in claim 10, wherein on the inner edge of said lateral wall, opposite said front wall, there are on one side first attachment elements and on the other side corresponding second attachment elements, said first attachment elements of one accessory being able to attach themselves with the corresponding second attachment elements of another accessory to define a single extension element for said modular elements.

* * * * *